United States Patent [19]

Utz et al.

[11] 3,956,867

[45] May 18, 1976

[54] METHOD OF PRODUCING A PACKAGE

[75] Inventors: Kastulus Utz, Freising; Josef Hartmut Esterhammer, Wasserburg; Arthur Vetter, Gronenbach, all of Germany

[73] Assignees: Multivac Sepp Haggenmueller KG, Wolfertschwenden; Alkor-Werk Karl Lissmann KG, Munich, both of Germany; part interest to each

[22] Filed: Dec. 23, 1974

[21] Appl. No.: 535,866

[30] Foreign Application Priority Data

Dec. 24, 1973 Germany ..... 2364565

[52] U.S. Cl. ..... 53/22 A; 53/30 S

[51] Int. Cl.[2] ..... B65B 31/02

[58] Field of Search ..... 53/22 A, 30 S

[56] References Cited

UNITED STATES PATENTS

| | | | |
|---|---|---|---|
| 2,991,600 | 7/1961 | Lancaster | 53/22 A |
| 3,286,835 | 11/1966 | Crane | 53/30 X |
| 3,621,588 | 11/1971 | Grocke | 53/184 X |
| 3,634,993 | 1/1972 | Pasco et al. | 53/22 A |
| 3,673,760 | 7/1972 | Canamero | 53/22 A |

*Primary Examiner*—Travis S. McGehee

*Attorney, Agent, or Firm*—Wolfgang G. Fasse; Willard W. Roberts

[57] ABSTRACT

In the present method a package is produced by forming a pouch in a first foil thereby stretching the material thus creating latent shrinking forces. The package is sealed using a second flat foil or a foil having a pouch extending to the opposite direction as the first pouch. The sealing is done inside an evacuated space and the heating of the first foil in order to shrink the pouch is done prior to or at the same time as the vacuum space is aerated.

10 Claims, 4 Drawing Figures

METHOD OF PRODUCING A PACKAGE

BACKGROUND OF THE INVENTION

This invention relates to a method of producing a package by forming a pouch in a first foil thereby stretching the material, putting the commodity to be packed into the space between this pouch and a second foil, sealing both foils together and shrinking the first foil in the area of the pouch by applying heat.

German Patent Publication DT-AS 1 145 087 discloses this method. By forming the pouch at a temperature below the softening point of the thermoplastic material a stretching is effected which makes the foil in the region of the pouch shrinkable thus effecting a complete or approximate restoration of the original plane shape by the application of heat.

In this publication (DT-AS 1 145 087) an evacuation of the package is not proposed.

It has also been proposed (U.S. Pat. No. 2,376,583) to cover the product to be packed by a foil which has been stretched on the whole. This foil is then fixed with a clamp and the air contained inside is evacuated to a certain extent. Finally the foil is shrunk by applying heat to eliminate wrinkles which may be caused by the atmospheric pressure.

In this last mentioned method the shrinking force is often insufficient to remove the wrinkles which are caused by the atmospheric pressure upon the evacuated package.

An apparatus for producing packages comprising a molding station, a filling station, and an evacuation and sealing station is described in the DT-AS 23 23 409.

OBJECT OF THE INVENTION

It is an object of the invention to obtain a package without wrinkles by applying the vacuum forming operation and the shrinking operation at the same time.

SUMMARY OF THE INVENTION

According to the invention this is achieved by provisionally or finally sealing the package in an evacuated space and thereby heating the first foil in the area of the pouch prior to or at the same time as aerating the vacuum space causing the shrinking.

The term provisional or final sealing means that it is important to obtain a tight seal between the first and the second foil prior to the aerating process thus preserving the vacuum inside the package during aerating. A further sealing may not be necessary. But if it is essential to keep the package tight in spite of rough treatment such sealing may be effected by pressing the first and the second foil against each other after the aerating process while keeping them at sealing temperature.

The shrinking process prior to or during the aerating secures that while the shrinking forces take effect the wrinkles caused by the aerating process are not formed or at least not yet fixed. The tendency to wrinkle is stopped because the foil is preferably shrunk at these spots where the tension is relieved due to the form of the product. When the foil is still warm with respect to the shrinking process when the vacuum is aired the foil engages the product even on concave areas.

It was found that the inventive method may be further improved by preshrinking the first foil after placing the product into the pouch but prior to its entry into the vacuum space. In this way the pouch adapts to the shape of the product to be packed during the preheating process. If for instance a slice of meat is placed in a concave pouch in the first foil the sides of the pouch will adapt to the rim of the meat during the preshrinking process. On the lower side of the slice there will be no essential shrinking as the meat still effects a cooling of the foil. The preheating must be so adjusted as to leave remaining shrinking forces for the final shrinking in the vacuum space.

The first foil with its filled pouch may be placed into a heating chamber within the vacuum space, the shape of the heating chamber conformed to the pouch, being heated to a temperature causing the shrinking. The preshrinking may not be necessary, particularly if the pouch will attach to the walls of the heating chamber by suction.

For moving the pouch into the heating chamber and to effect a complete contact between the foil and the heated walls, the vacuum inside the heating chamber may temporarily be made higher than in the rest of the vacuum chamber. In this way the sides of the pouch are sucked to the heated walls of the heating chamber and heated to a temperature to release the shrinking forces. But these forces can not yet effect a shrinking because the pouch is kept, for the present, within the heating chamber by the higher vacuum.

When the vacuums inside the heating chamber and the rest of the vacuum chamber are equalized the shrinking forces released by the prior heating will effect the shrinking.

The amount of heat applied to the pouch depends on the commodities to be packed. If for instance meat is to be packed the heat applied to the main surface of the slice must be less than the heat applied to the rim. This means that the pouch will be heated more along its sides than on its bottom.

If a heating chamber inside the vacuum chamber is used the sealing may be effected by approaching a sealing plate to the rim of the heating chamber.

Another possibility to heat the vacuum chamber during the aeration of the vacuum space consists in venting the heating chamber with heated air.

As to the basic configuration there are two possibilities:

The first foil may be provided with a concave pouch which is open at its top and for the second foil a flat web is used.

According to the second possibility the first foil is provided with a concave pouch which is open at its top and the second foil is provided with a concave pouch which is open at its bottom.

BRIEF FIGURE DESCRIPTION

In order that the invention may be more clearly understood, it will now be described, by way of example, with reference to the accompanying drawings, wherein.

DETAILED DESCRIPTION OF EXAMPLE EMBODIMENTS

Figure 1:
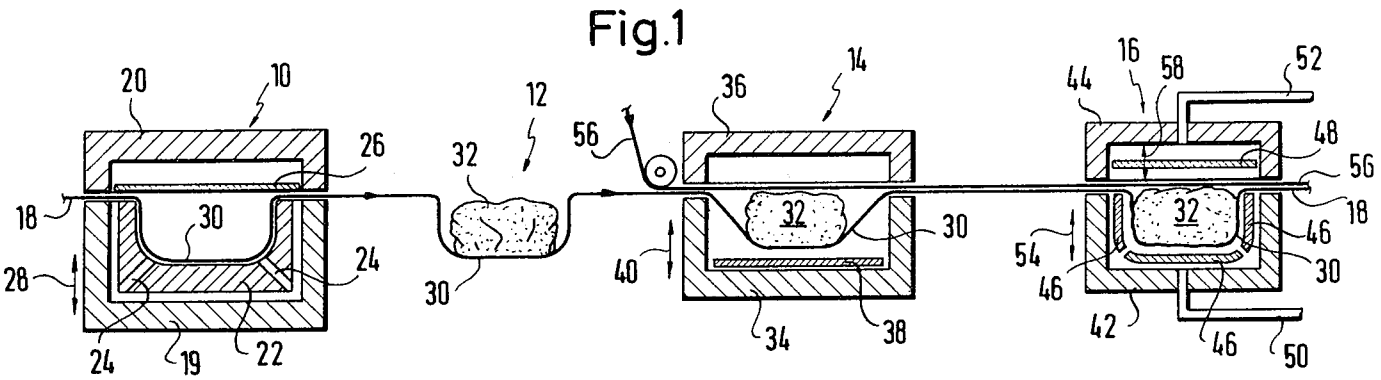
FIG. 1 represents a diagrammatic view of a first embodiment of an apparatus to perform the method of this invention.

FIG. 1 shows a molding station 10, a filling station 12, a preheating station 14 and an evacuating station 16.

The web 18 is fed from the left to the molding station 10. This station consists of a lower tool member 19 and an upper tool member 20. The lower tool member 19 contains a mold 22 which is provided with ducts 24. These ducts may be connected to a pressure source or a vacuum pump. The upper tool member 20 contains a heater 26. At least the lower member 19 can be moved up and down in the direction of the arrow 28.

After a piece of the foil 18 has been fed into the tool the lower member 19 is moved up to contact the upper member 20. By applying a pressure source to the ducts 24 the foil 18 is made to contact the heater 26 completely and its temperature is increased to its stretching temperature. This temperature is somewhat below the melting point of the foil because only at temperatures below the melting point stretching is possible which leads to latent shrinking forces.

After that the ducts 24 are disconnected from the pressure source and connected to a vacuum pump. The area of the foil 18 which covers the mold 22 is then formed into a pouch 30 and at the same time stretched in a way to make it shrink later when heat is applied again.

The lower tool member 19 is now moved in its lower position so as to laterally release the pouch 30, and in the next step the pouch 30 is moved to the filling station 12.

In the filling station 12 the commodity to be packed is placed in the pouch 30.

The filled pouch 30 is then moved to the preheating station 14 which also consists of a lower tool member 34 and an upper tool member 36. The lower tool member 34 contains a heater 38 and is movable in the direction of the arrow 40. While moving the pouch 30 with the product 32 into the tool 14 the lower member 34 is in its lower position so as not to obstruct the moving pouch. After that the lower member 34 is lifted to bring it into contact with the upper member 36. The heater 38 radiates heat to the pouch 30 which starts to shrink to an extent determined by the weight of the product 32. The shrinking occurs especially in the sides of the pouch 30 which do not touch the product 32. No or only slight shrinking takes place where the product touches the pouch because of the cooling effect of the product and also because of its mechanical resistance.

When the preshrinking process is completed the lower tool member 34 is moved downward to allow the pouch 30 with the product 32 to be moved to the vacuum station 16.

The vacuum station 16 consists of a lower tool member 42 and an upper tool member 44. Inside the lower member 42 the heater 46 and inside the upper member 44 the heater 48 are arranged. Via a pipe 50 the lower member 42 may be connected to atmospheric pressure or a vacuum pump and via a pipe 52 the upper member 44 may be connected to atmospheric pressure or a vacuum pump. The lower tool member 42 may be moved up or down in the direction of the arrow 54.

When the filled pouch 30 is to be moved into the vacuum station the lower member 42 is in its lower position. It is moved up when the pouch 30 is in a position above it and the pouch 30 is now in the space formed by the heaters 46. Together with the first foil 18 a second foil 56 is fed to the vacuum station which has been advanced to the first foil in the preheating station 14 already in order to preheat it. When the first foil 18 and the second foil 56 have entered the vacuum station 16 the pipes 50 and 52 are connected to vacuum pumps in order to evacuate the interior of the space formed by the tool members 42 and 44 and also the interior of the package formed by the first and the second foil. At the same time the pouch 30 is heated by the heaters 46 and the area of the second foil 56 on top of the pouch 30 is heated by the heater 48. The heating causes the shrinking of foil 18 in the area of the pouch 30 because the latent shrinking forces are released. At the same time the foils 18 and 56 can be sealed. To effect this sealing the heater 48 is movable in the direction of the arrow 58. The heater 48 is moved down as soon as the package is sufficiently evacuated and the foils 18 and 56 are sufficiently hot. When the sealing has been completed the vacuum chamber formed by the tool members 42 and 44 is aerated with the effect that the pouch 30 is deformed. Due to the continuous heating of the pouch 30 sufficient shrinking forces are left to prevent wrinkles at regions where a tendency to wrinkles exists because of the draping. These wrinkles are prevented even before they develop by a compensating shrinking. In addition the plastic state of the foils 18 and 56 causes the foils to be pressed into all concave surfaces of the product 32 thereby establishing a complete contact.

Figure 2:
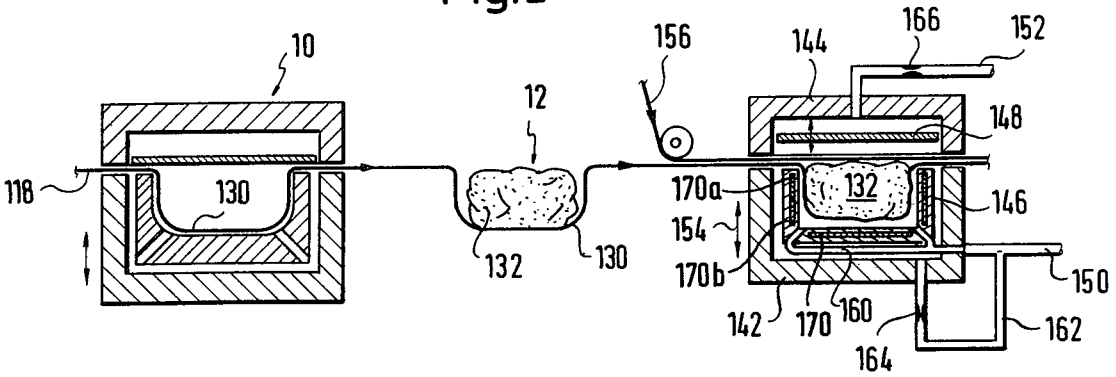
FIG. 2 represents a diagrammatic view of a second embodiment of an apparatus to perform the method of the invention.

In the embodiment of the apparatus illustrated in FIG. 2 the molding station and the filling station are the same as in FIG. 1 but the preheating station has been omitted and the evacuation station is of an alternate configuration. Due to the omission of the preheating station the second foil 156 is advanced to the lower foil 118 immediately before they enter the evacuation station 116.

The evacuation station according to FIG. 2 comprises a lower tool member 142 and an upper tool member 144. Inside the lower member 142 a heating chamber 146 is provided. A pipe 160 connects the heating chamber 146 to the pipe 150, which may be connected to atmospheric pressure or to a vacuum pump as in FIG. 1. A branch line 162 extends from the pipe 150 via a throttle 164 to the lower member 142. As in the embodiment shown in FIG. 1 the upper tool member 144 is provided with a pipe 152 which may be connected to atmospheric pressure or a vacuum pump. The heater 148 inside the upper tool member 144 may also be moved up and down, as explained in connection with the embodiment according to FIG. 1. The walls of the heating chamber 146 comprise heating elements 170, 170*a*, 170*b*.

When the pouch 130 together with the upper foil 156 has entered the vacuum chamber formed by the tool members 142, 144, and the pouch 130 is positioned above the heating chamber 146, the lower tool member 142 is moved up to close the vacuum chamber as shown by the arrow 154. Now the pipe 150 is connected to the vacuum pump. This results in a higher vacuum inside the heating chamber 146 than in the rest of the vacuum chamber because of the throttles 164 and 166 in the pipes 162 and 152 respectively. The existing pressure difference between the interior of the heating space 146 and the rest of the vacuum chamber causes the pouch 130 to contact the walls of the heating chamber 146 completely. Thus the pouch 130 is heated quickly and efficiently; for this reason the preheating may be omitted. After some time the pressures between the interior of the heating chamber 146 and the rest of the vacuum chamber are equalized and the pouch 130, which was pressed against the walls of the heating chamber 146 before, starts to shrink and adapt to the product 132 to be packed. After completion of the vacuum the heater 148 is forced down to effect the heat sealing of the foils 118 and 156.

When the vacuum space of the evacuation station 116 is aerated the pouch is subjected to the atmospheric pressure and the pouch is pressed against the commodity as explained in connection with FIG. 1. As explained in connection with the embodiment of FIG. 1, the latent shrinking forces and the plastic state of the foil prevent the forming of wrinkles and cause the foil to adapt even to concave surfaces of the product 132.

Very high vacuums up to 98% may be used in the vacuum station. These vacuums possess the advantage that only small amounts of oxygen are left in the packages and therefore the packed goods may be stored for a long time. If the shrinking was done after the evacuation according to the method disclosed in the US-PS 2 376 583, these high vacums would cause a fixation of the wrinkles created by the evacuation and the following aeration, which would make the removal of these wrinkles impossible.

According to the method of the invention foils may be used which start to seal at shrinking temperatures already. This would be impossible with a method according to the US-PS 2 376 583, because if temperatures were used for shrinking which are as high as the sealing temperatures, the wrinkles would be sealed before they could be prevented by shrinking.

With the inventive method it is possible to seal the foils 30 and 56 and effect the shrinking of the foil 30 at the same temperature.

Figure 3:
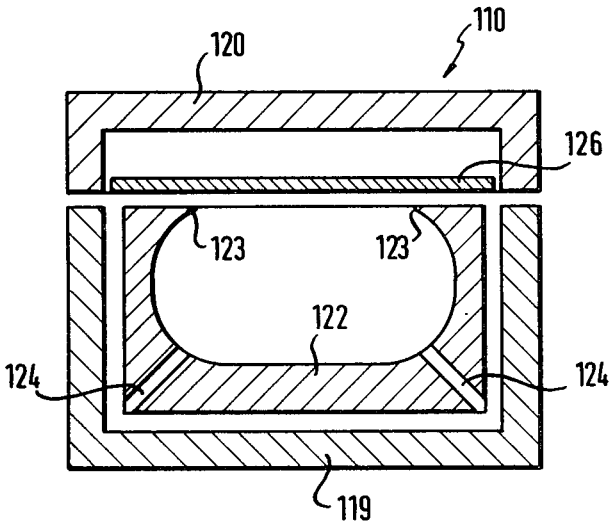
FIG. 3 represents an alternate construction of a chamber for forming the package.

FIG. 3 represents an alternate construction of the molding station 110. In this embodiment the mold 122 is provided with a protrusive edge 123. The rest of the molding station corresponds to the stations according to FIGS. 1 and 2. By using a modified molding station 110 as shown in FIG. 3 a pouch 230 is formed as shown in FIG. 4.

Figure 4:
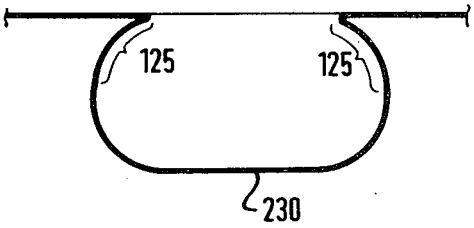
FIG. 4 represents a pouch which is produced by using the tool according to FIG. 3.

The protrusive edges 123 cause an increased stretching in the region 125 of the pouch 230, which is shown in FIG. 4, thus creating stronger latent shrinking forces in this region. This is important because according to experience without the protrusive edges 123 the stretching is least in this region while the thickness of the foil is at its maximum. Without the protrusive edge the shrinking force would be least and the shrinking rendered even more difficult because of the higher heat capacity because of the thickness of the foil in this region.

Due to the increased stretching in the region 125 caused by the protrusive edge 123 there is also an increased shrinking capacity exactly where it is needed and where a surplus of material has to be dissolved.

Different materials may be used to perform the inventive method. Especially suitable are foils composed of more than one ply which consist of a film of a higher melting temperature and a film of lower melting temperature. The films with the lower melting temperatures face each other and are used for sealing while the films of higher melting temperatures supply most of the shrinking force.

The term "sealing" is intended to cover any form of joining two foils by using pressure and heat notwithstanding whether these foils are suitable for sealing or one or the other foil is covered with a heatactivated adhesive.

Best results could be obtained by the use of polyethylenefilms polyamide-foils, the polyethylenefilms facing each other and effecting the sealing.

As an example only the following specifications of polyethylene-polyamide-foils are mentioned:

1. The polyethylene-film consisted of an ionomer-resin based on Na-ions (Trade name "Surlyna" of Du Pont); the melting index of this material was 0.7, the layer thickness 50 mμ.
   The polyamide-film consisted of a polyamide 6/11 copolymer with a thickness of 20 mμ.
2. The polyethylene-film consisted of an ionomer-resin based on zinc-ions; the melting index was 2.0, the layer thickness was 70 mμ.
   The polyamide-film consisted of a polyamide 6/11 copolymer, its thickness was 20 mμ.
3. The polyethylene-film consisted of a high pressure polyethylene with a density of 0.92 and a melting index of 0.4; the thickness was 80 mμ.
   The polyamide-film was the same as in example 2.

What is claimed is:

1. A method of producing a package without wrinkles by applying a vacuum forming operation and a heat shrinking operation comprising:

a. forming a pouch in a first foil and thereby stretching the material;
b. putting the commodity to be packed into the pouch;
c. advancing a second foil to the first foil;
d. sealing the package in an evacuated space;
e. heating the first foil in the area of the pouch prior to or at the same time as; and
f. aerating the evacuated space at the same time or subsequent said step of heating the first foil in the area of said pouch and subsequent said sealing of said package.

2. The method of claim 1 further comprising preshrinking the filled pouch before moving it into the evacuated space.

3. The method of claim 1 further comprising placing the filled pouch into a conformed heating chamber inside the evacuated space.

4. The method of claim 3 further comprising providing a higher vacuum inside the heating chamber than in the rest of the evacuated space to suck the pouch to the walls of the heating chamber;

equalizing the pressures in the heating chamber and the rest of the evacuated space so as to effect a shrinking by the shrinking forces released by heating in the heating chamber.

5. The method of claim 4 further comprising heating the pouch along its sides to a higher temperature than its bottom.

6. The method of claim 4 further comprising approaching a heated sealing plate to the rim of the heating chamber to effect the sealing.

7. The method of claim 1 further comprising aerating the heating chamber with heated air.

8. The method of claim 1 further comprising providing the first foil with a concave pouch which is open at its top and using a flat web for the second foil.

9. The method of claim 1 further comprising providing the first foil with a concave pouch which is open at its top and providing the second foil with a pouch which is open at its bottom.

10. The method of claim 1 wherein said step of forming a pouch comprises forming a pouch with protrusive edges along its rim in order to cause stronger latent shrinking forces in these regions of the pouch.

* * * * *

UNITED STATES PATENT OFFICE

CERTIFICATE OF CORRECTION

Patent No. 3,956,867 Dated May 18, 1976

Inventor(s) Kastulus Utz et al

It is certified that error appears in the above-identified patent and that said Letters Patent are hereby corrected as shown below:

Column 6, line 33 after "space" insert --; and--

Column 6, line 35 after "as" delete "; and"

Signed and Sealed this

Twenty-first Day of September 1976

[SEAL]

*Attest:*

RUTH C. MASON
*Attesting Officer*

C. MARSHALL DANN
*Commissioner of Patents and Trademarks*